US009145224B2

(12) United States Patent
West et al.

(10) Patent No.: US 9,145,224 B2
(45) Date of Patent: Sep. 29, 2015

(54) PAPER CONTAINER HAVING A REINFORCED NECK

(76) Inventors: Ellery West, Crescent City, CA (US); Gail West, Crescent City, CA (US)

( * ) Notice: Subject to any disclaimer, the term of this patent is extended or adjusted under 35 U.S.C. 154(b) by 945 days.

(21) Appl. No.: 13/376,949

(22) PCT Filed: Jun. 7, 2010

(86) PCT No.: PCT/US2010/037583

§ 371 (c)(1),
(2), (4) Date: Jan. 11, 2012

(87) PCT Pub. No.: WO2010/144340

PCT Pub. Date: Dec. 16, 2010

(65) Prior Publication Data

US 2012/0097632 A1 Apr. 26, 2012

Related U.S. Application Data

(60) Provisional application No. 61/186,278, filed on Jun. 11, 2009.

(51) Int. Cl.

| | |
|---|---|
| ***B65D 1/02*** | (2006.01) |
| ***B65D 1/48*** | (2006.01) |
| ***B65D 6/00*** | (2006.01) |

(52) U.S. Cl.
CPC *B65D 1/48* (2013.01); *B65D 1/023* (2013.01); *B65D 13/04* (2013.01)

(58) Field of Classification Search
CPC ..... B65D 1/48; B65D 1/023; B65D 13/04
USPC ..... 215/12.2, 12.1, 13.1, 42, 44, 50, 387; 428/34.3, 35.6, 36.4; 220/62.12, 62.19, 220/62.2, 703
See application file for complete search history.

(56) References Cited

U.S. PATENT DOCUMENTS

| | | | |
|---|---|---|---|
| 2,069,033 | A | 1/1937 | Guenther |
| 2,382,873 | A | 8/1945 | Goodwin |
| 4,525,396 | A | 6/1985 | Takasa et al. |
| 5,213,238 | A | 5/1993 | Martin et al. |
| 5,305,931 | A | 4/1994 | Martin et al. |
| 5,356,518 | A | 10/1994 | Kelley et al. |

(Continued)

FOREIGN PATENT DOCUMENTS

| | | |
|---|---|---|
| DE | 60129006 | 4/2007 |
| EP | 1260447 | 11/2002 |

(Continued)

*Primary Examiner* — Robert J Hicks
*Assistant Examiner* — Kareen Rush
(74) *Attorney, Agent, or Firm* — Fish & Tsang LLP

(57) ABSTRACT

A container (100) configured to house a fluid or other liquid, semi-solid, or solid composition has a body having a pulp-molded portion (130) and a side wall (104) that at least partially defines a coated lumen (118). The container can include a neck (116) that has an open end and is coupled to the body. A heterocompositional frame (114) can be used to reinforce the neck (116). The container (100) can include a permeation barrier material or other coating to act as a barrier between the container's walls and the container's contents. A method of reinforcing a neck (116) in a pulp-molded bottle is also disclosed. The method includes the step of providing a frame material that is heterocompositional to a material of the bottle. The method also includes the step of applying the frame material to the neck (116) of the bottle.

18 Claims, 3 Drawing Sheets

(56) References Cited

U.S. PATENT DOCUMENTS

| | | | | |
|---|---|---|---|---|
| 5,507,419 | A | 4/1996 | Martin et al. | |
| 5,524,778 | A * | 6/1996 | De Caluwe et al. | 215/12.2 |
| 5,540,962 | A | 7/1996 | Suskind | |
| 5,693,283 | A * | 12/1997 | Fehn | 264/513 |
| 6,454,906 | B1 | 9/2002 | Nonomura et al. | |
| 6,461,480 | B1 | 10/2002 | Otakura et al. | |
| 6,468,398 | B1 | 10/2002 | Kumamoto et al. | |
| 6,479,115 | B2 * | 11/2002 | Fehn | 428/36.6 |
| 6,645,348 | B2 | 11/2003 | Kumamoto et al. | |
| 6,677,013 | B1 * | 1/2004 | Curie et al. | 428/35.7 |
| 6,899,793 | B2 | 5/2005 | Nomomura et al. | |
| 7,048,975 | B1 | 5/2006 | Tojo et al. | |
| 7,067,041 | B2 | 6/2006 | Tsuura et al. | |
| 7,077,933 | B2 | 7/2006 | Otani et al. | |
| 7,370,788 | B1 | 5/2008 | Otani et al. | |
| 2003/0010462 | A1 | 1/2003 | Nonomura et al. | |
| 2003/0029591 | A1 | 2/2003 | Otani et al. | |
| 2003/0145968 | A1 | 8/2003 | Kumamoto et al. | |
| 2003/0150582 | A1 | 8/2003 | Tsuura et al. | |
| 2003/0209337 | A1 | 11/2003 | Nonomura | |
| 2004/0043168 | A1 | 3/2004 | Ishikawa et al. | |
| 2007/0181591 | A1 | 8/2007 | Pierce et al. | |
| 2007/0292643 | A1 | 12/2007 | Renn | |
| 2008/0138458 | A1 | 6/2008 | Ozasa et al. | |
| 2008/0237247 | A1 | 10/2008 | Mucci et al. | |
| 2008/0286420 | A1 | 11/2008 | Domingues et al. | |
| 2008/0302808 | A1 | 12/2008 | Maxwell | |
| 2009/0008819 | A1 | 1/2009 | Ozasa et al. | |
| 2009/0081396 | A1 | 3/2009 | Hokari et al. | |

FOREIGN PATENT DOCUMENTS

| | | |
|---|---|---|
| GB | 2432829 | 8/2008 |
| JP | 2001-315739 | 11/2001 |
| WO | 01/64527 | 9/2001 |
| WO | 2008/051653 | 5/2008 |
| WO | 2008/055955 | 5/2008 |
| WO | 2009/034344 | 3/2009 |
| WO | 2009/039314 | 3/2009 |

* cited by examiner

PAPER CONTAINER HAVING A REINFORCED NECK

RELATED APPLICATIONS

This application claims priority and herein incorporates by reference U.S. provisional patent application Ser. No. 61/186,278, filed Jun. 11, 2009.

FIELD OF THE INVENTION

The field of the invention is pulp-molded containers.

BACKGROUND

Waste has been a prominent problem in the modern world. Much of the waste comes from plastic and/or metal, which decomposes at a very slow rate. These materials must be recycled, dumped into the oceans or waterways, or deposited into landfills where they will remain for centuries.

In order to reduce the waste in our ever-filling landfills, it is advantageous to create containers that are biodegradable and/or compostable. U.S. Pat. No. 1,415,100 to Lang describes a paper bottle having a neck portion that is strengthened by increasing the amount of pulp used in forming the neck. However, the additional pulp fails to increase the tensile strength of the neck, as the additional pulp comprises the same material that forms the body. Thus, as additional force is used to place a cork or other stopper in the neck, the neck portion can crack and subsequently leak.

Lang and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

U.S. Pat. No. 1,540,726 to Moore, U.S. Pat. No. 1,602,925 to Moore, and U.S. Pat. No. 2,027,484 to Koch describe reinforcing the neck of paper containers by folding the sidewall over the mouth of the containers to add additional layers to the neck. However, such methods also fail to sufficiently increase the tensile strength to withstand insertion of a cork or other stopper.

It is also known to reinforce the neck portion by additional paper layers, as described in United Kingdom Pat. No. 401019 to Farrow, U.S. Pat. No. 1,342,013 to Chenery, and U.S. Pat. No. 1,415,100 to Lang. However, such reinforcement suffers from the same problem as above.

It is further known to strengthen the neck portion by adding one or more ribs formed about the neck portion, as described in U.S. Pat. No. 2,090,699 to Plunkett.

All of the above methods, while strengthening the neck portion, fail to sufficiently increase the tensile strength of the neck portion such that the neck can withstand forced insertions of corks or other stoppers into the bottles.

U.S. Pat. No. 1,525,399 to Kerkhof discusses utilizing a metal ring to strengthen a the neck of a receptacle. However, the metal ring is not biodegradable and would therefore add to the existing waste problem.

Thus, there is still a need for a reinforced neck portion comprising a frame having a material that is heterocompositional from that of the paper container.

SUMMARY OF THE INVENTION

The inventive subject matter provides apparatus, systems and methods in which a container for housing a fluid comprises a pulp-molded container having a reinforced neck.

The containers advantageously have a heterocompositional strut or other framework configured to reinforce the neck. As used herein, the term "heterocompositional" is defined to mean a non-identical and separate material than the material used to form the neck. Preferred frames comprise long fibrous materials formed concentrically around the neck. However, any commercially suitable materials could be used as a frame, including for example, Kraft or other papers, strings, fibrous materials, and/or combinations thereof. Thus, for example, a neck could have a first portion formed from a paper pulp, and a second, frame portion formed from string. As another example, a neck could be formed from a first type of paper pulp, and the frame could be formed from a second type of paper pulp. However, a container where the neck is composed essentially of rolled paper, a frame member of more of the same type of rolled paper would not comprise a heterocompositional portion.

As used herein "fibrous material" means materials characterized by a plurality of discrete fibers. The filaments can be plant or animal derived, synthetic, or some combination of these. In "plant-derived fibrous materials" the filaments are at least predominantly of plant origin, examples of which include wood, papyrus, rice, ficus, mulberry, fibers, cotton, yucca, sisal, bowstring hemp and New Zealand flax. Paper is generally a fibrous material that is usually made by pressing and de-watering moist fibers, typically cellulose pulp derived from wood rags, or grasses.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Preferred containers are formed from one or more biodegradable materials, and include a closed bottom, an open top, and a fibrous side wall that at least partially defines a coated lumen. As used herein, "lumen" means the inner space defined by the walls of the container. As used herein, "fibrous side wall" means a wall comprising a fibrous material as a significant structural constituent. The fibrous walls contemplated herein preferably have at least 2, 5, 10, 20 or even 30 dry weight percent of fibers. Preferably, the fibrous walls have at least 80 or 90 dry weight percent of fibers.

As used herein, a "biodegradable material" means a material that will break down to at least 90% $H_2O$, $CO_2$, and biomass within a period of six months from the action of naturally occurring micro-organisms such as bacteria, fungi, algae etc. under favorable conditions. For example, meat, plants, wood, cotton, animal protein, and paper are all deemed herein to be biodegradable.

At least a portion of the inner surface of the side wall can advantageously include a permeation barrier material to reduce the transfer rate of the side wall. As used herein, a statement that a wall of a container that "includes a permeation barrier material" means that the wall is treated with an additive that has a transfer rate of less than or equal to 50 μl of water and/or sunflower oil per $cm^2$ per six-month period of time at room temperature and normal atmospheric pressure (STP). Alternatively as used herein, a permeation barrier could compose a liner that is preferably biodegradable, and that may or may not be adhered to the interior of the vessel. Furthermore, the permeation function may be achieved by use of a treatment to the fibrous material that thereby renders it impervious to liquids before molding.

Preferred permeation barriers comprise vegetable or petroleum wax, vulcanized latex, plant resins, polylactic acid polymer (PLA), and cellophane. Other suitable permeation barrier materials include those disclosed in U.S. Pat. No. 7,344,784 to Hodson or US20050130261 to Wils.

The walls of the neck are preferably formed around at least one frame, such that the frame becomes embedded within the wall of the neck. Thus, similarly to rebar in concrete, the frame increases the tensile strength of the neck of the bottle, such that the neck can withstand the insertion of a cork or other stopper.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
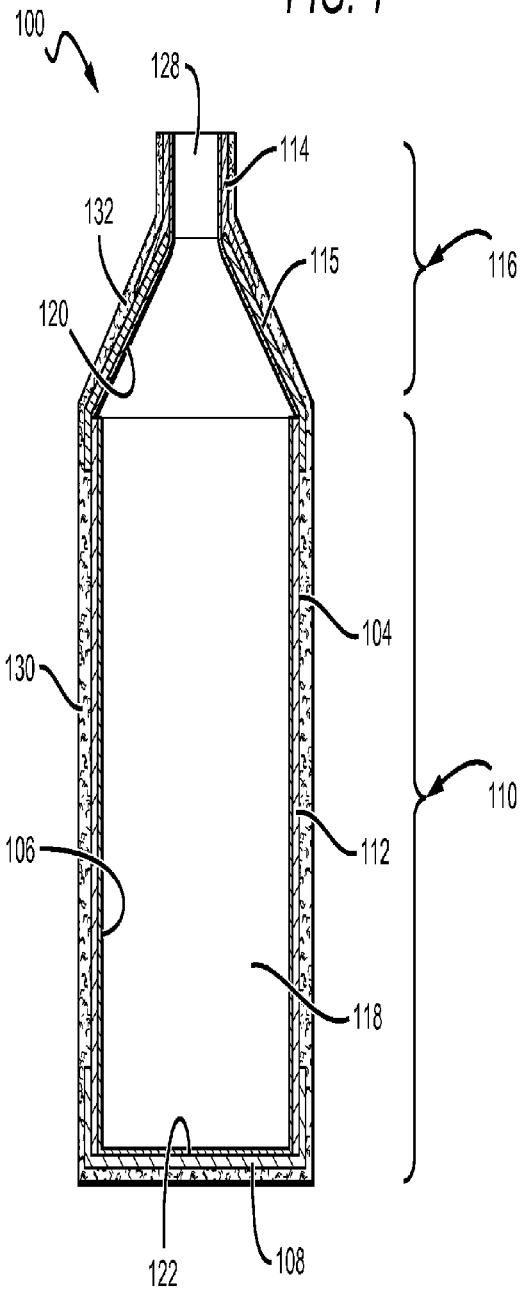
FIG. 1 is cross-sectional view of an embodiment of a container.

In FIG. 1, a container 100 is shown for housing a fluid, or other liquid, solid, or semi-solid contents, that includes a body 110 having a pulp-molded portion 130 and an optional side wall 104 that at least partially defines a coated lumen 118. The container 100 can also include a neck 116 that is coupled to the body 110 and that has a pulp-molded portion 132 and a heterocompositional frame portion 114 configured to reinforce the neck 116.

The optional side wall 104 can be formed from any commercially suitable materials, and preferably those materials that are biodegradable. While the side wall 104 could have any thickness, the side wall 104 preferably has a thickness of between 1 mm to 10 mm. An exterior surface 112 of the side wall 104 and a bottom portion 108 of the container 100 could be made from a single piece of material, but preferably the bottom portion 108 is a separate piece that fits around a portion of the exterior surface 112. It is also contemplated that the bottom portion 108 could fit around an interior portion of the side wall 104.

Side wall 104 can define a lumen 118 within the container 100 in which a liquid or other liquid, solid, or semi-solid composition can be housed. Preferably, the side wall 104 includes a permeation barrier material 106 or other coating, which may be on an inside of, an outside of, or within the side wall 104. For example, in some contemplated embodiments, the coating 106 can be disposed on an inside of the side wall 104, such that the coating 106 acts as a barrier between the side wall 104 and the composition housed within the container 100. However, it is also contemplated that the coating 106 or an additional coating can be disposed on an exterior surface 112 of the side wall 104, or be impregnated within the side wall 104. Preferably, the coating 106 allows at least a portion of the container 100 to be water-resistant.

In other contemplated embodiments that lack a side wall, the pulp molded portion 130 can have a coating disposed on an inside of, an outside of, or within the pulp molded portion 130.

Figure 3A:
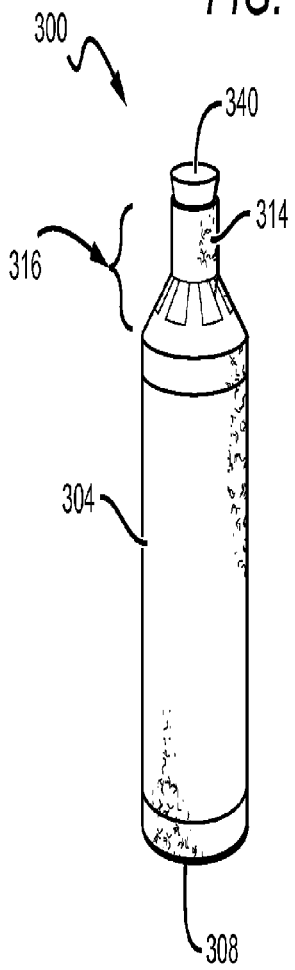
FIGS. 3A-3C are perspective views of three embodiments of a container.
Figure 3B:
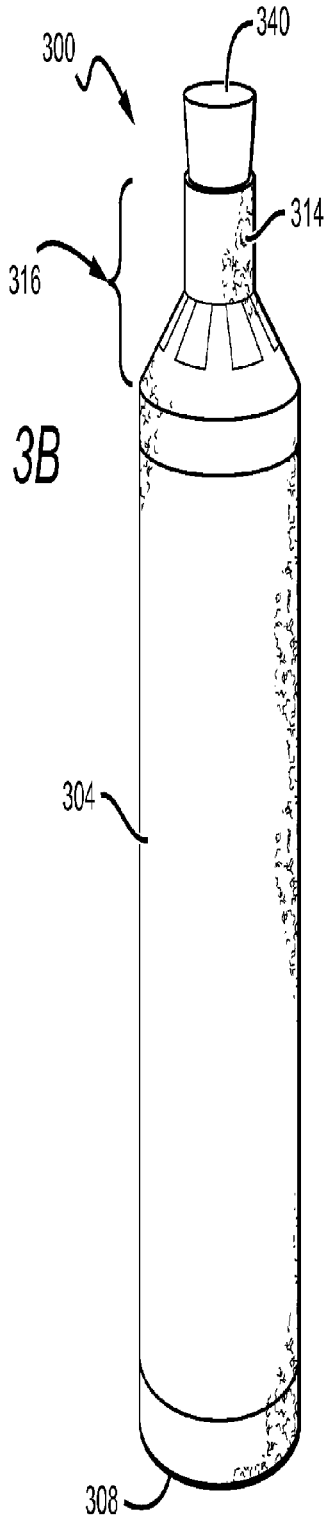
Figure 3C:
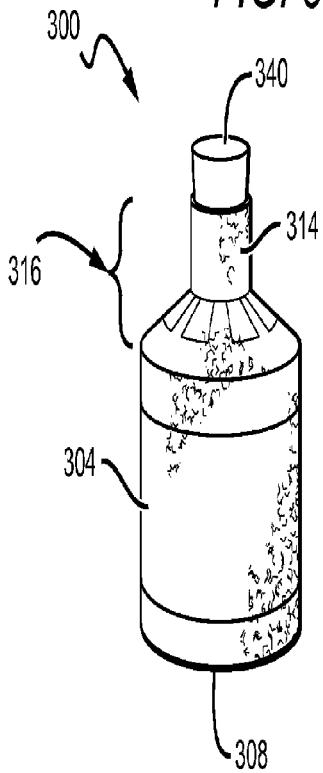

The neck 116 is preferably tapered, and defines an opening 128 into which a cork or other stopper can be inserted to seal the opening 128. Exemplary corks are shown in FIGS. 3A-3C, and exemplary stoppers are described in U.S. patent application Ser. No. 12/764,187 filed on Apr. 21, 2010.

A frame portion 114 can be disposed about at least a portion of the pulp molded portion 132 of the neck 116. Preferably, the frame portion 114 is heterocompositional in relation to the pulp molded portion 132, and the specific material of the frame portion 114 is chosen to reinforce the neck 116. In some contemplated embodiments, the frame portion 114 can comprise Kraft paper or other types of paper. However, it is also contemplated that the frame portion 114 could comprise any commercially suitable biodegradable materials including, for example, papers and other fibrous materials, strings, plant starch based polymers, and any combination(s) thereof. In addition to being disposed on an interior of the pulp molded portion 132, it is contemplated that the frame portion 114 could be disposed within the pulp-molded portion 132 or on an exterior of the pulp molded portion 132.

The neck 116 can also include a shoulder portion 115 that couples the frame portion 114 to the side wall 104, although in other contemplated embodiments, the container can instead have the frame portion 114 coupled to the side wall 104 without an intermediary shoulder portion 115.

The neck 116 can include a permeation barrier material or other coating 120, which may be on an inside of, an outside of, or within either or both of the pulp molded portion 132 and the frame portion 114 of neck 116. For example, in some contemplated embodiments, the coating 120 can be disposed on an inside of the frame portion 114. Similarly, the bottom portion 108 can also include a permeation barrier material or other coating 122, on an inside of, an outside of, or within bottom portion 108. While preferably coatings 106, 120, and 122 have the same composition, it is also contemplated that one or more of coatings 106, 120, and 122 can have a different composition from another of the coatings 106, 120, and 122.

The body 110 of the container 100 can have a pulp molded portion 130 composed of a paper mâché applied to an exterior surface 112 of the side wall 104, for example, although fibrous pulps and other commercially suitable composition(s) can alternatively or additionally be applied to the exterior surface 112. In addition, it is contemplated that the pulp-molded portion 130 of the body 110 can be formed without the need for a side wall 104, such as through injection molding or other processes.

Figure 4A:
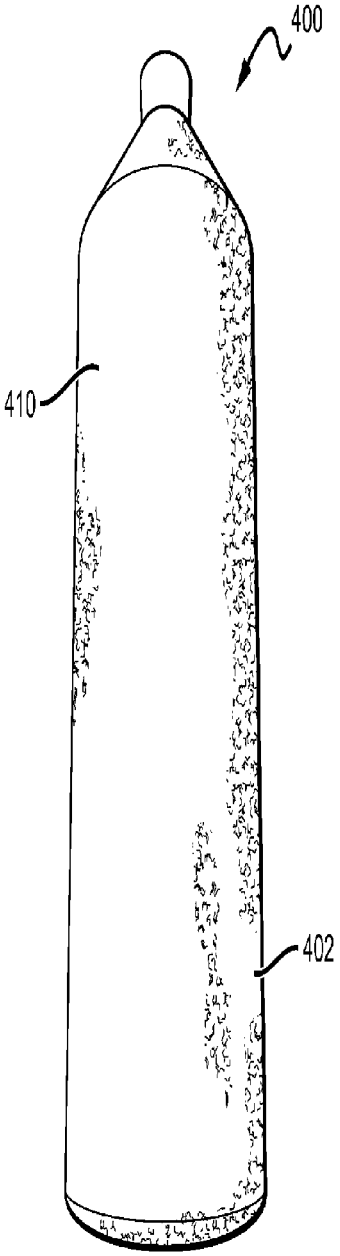
FIGS. 4A-4B are side and top views, respectively, of a container.
Figure 4B:
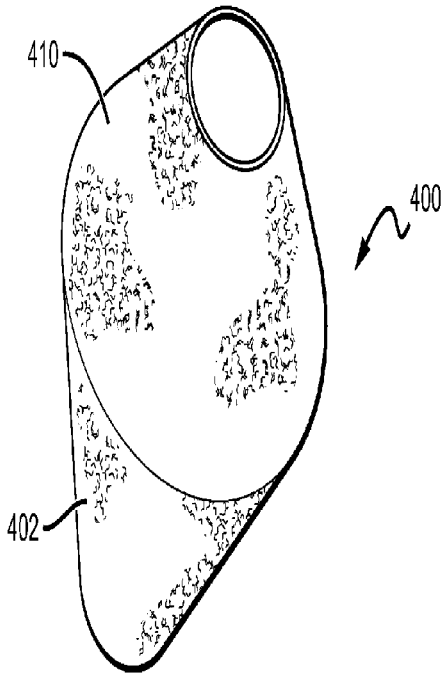

The paper mâché or other commercially suitable composition(s) can also be applied to the frame portion 114 of the neck 116 and/or the bottom portion 108 of container 100. An exemplary container having the paper mâché or molded paper is shown in FIGS. 4A-4B. It is alternatively contemplated that the side wall 104 or frame portion 114 can be disposed on an exterior of the body 110.

Figure 2:
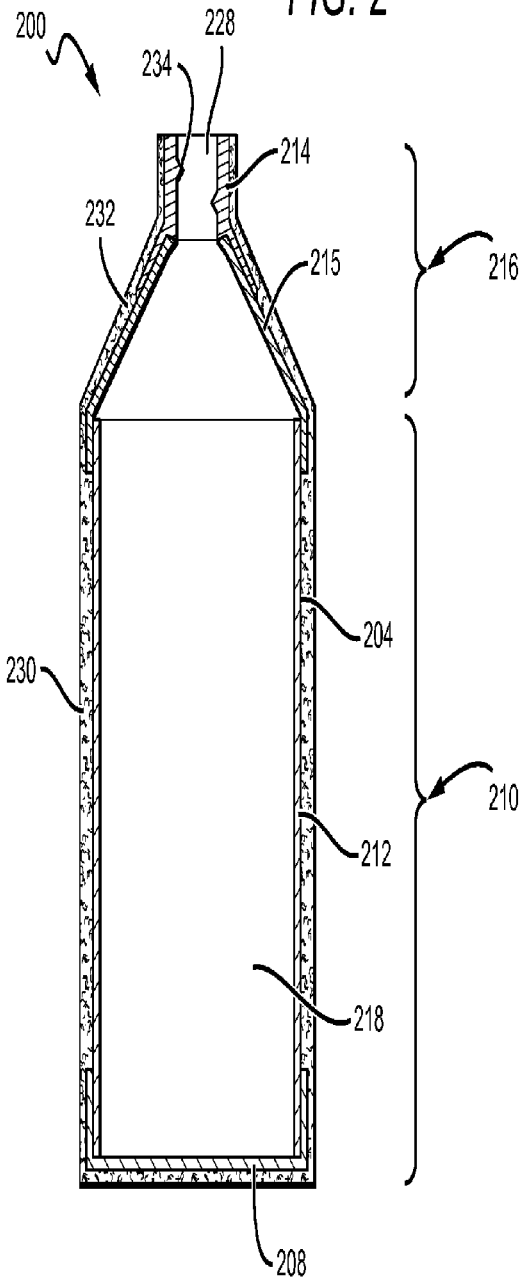
FIG. 2 is cross-sectional view of another embodiment of a container.

In some contemplated embodiments shown in FIG. 2, one or both of the neck frame 214 and side wall 204 can provide moisture resistance without the need for a separate coating. For example, the neck frame 214 and side wall 204 could comprise PLA that also provides a moisture barrier and thereby reduces or eliminates the need for a separate coating. The neck frame 214 and side wall 204 could have a thicker portion at the neck 216 of the container 200 to increase the structural integrity of the container's neck 216, and a thinner portion at the side wall 204. Optionally, the neck frame 214 can include a contoured portion 234 or threads that are sized and dimensioned to the external configuration of a stopper.

With respect to the remaining numerals in FIG. 2, the same considerations for like components with like numerals of FIG. 1 apply.

In FIGS. 3A-3C, a container 300 is shown comprising a side wall 304 formed of a hollow cardboard tube, although any commercially suitable materials could be used, and preferably those materials that are biodegradable. The container 300 can include a neck portion 316 comprising a frame 314 that couples the neck portion to the side wall 304, and thereby reinforces the neck portion 316. The bottom 308 of the container can be formed from paper or other commercially suitable materials. A stopper 340 can be inserted into the opening in the neck portion 316 to thereby seal the container 300.

As shown in FIGS. 4A-4B, the container 400 can have a pulp-molded body formed from a paper mâché 410, fibrous pulp, or other commercially suitable composition(s) being applied to an exterior 402 of the strengthened container 400.

Figure 5:
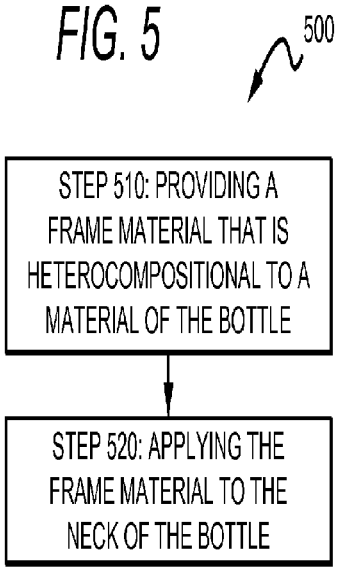
FIG. 5 is a flowchart of a method of reinforcing a neck of a pulp-molded bottle.

In FIG. 5, a method 500 is shown for reinforcing a neck of a pulp-molded bottle. In step 510, a frame material can be provided that is heterocompositional with respect to a material of the bottle. In step 520, the frame material can be applied to the neck of the bottle to thereby reinforce the bottle's neck.

In some contemplated embodiments, the frame material can be paper or other fibrous materials, string, plant starch based polymers, and any other biodegradable materials, which increases the tensile strength of the bottle's neck.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A container for housing a fluid, comprising:

a body having a first pulp-molded portion and a side wall that at least partially defines a coated lumen; and a neck coupled to the body, the neck having a second pulp-molded portion barrier and a heterocompositional frame portion configured to reinforce the neck; and wherein the frame portion is disposed between the second pulp-molded portion and the permeation barrier, and is biodegradable.

2. The container of claim 1, wherein the frame portion is composed of paper.

3. The container of claim 1, wherein the frame portion is composed of string.

4. The container of claim 1, wherein the frame portion is composed of fibrous material.

5. The container of claim 1, wherein the frame portion is composed of a plant starch based polymer.

6. The container of claim 1, wherein the container is water-resistant.

7. The container of claim 1, wherein the container has a tapered portion.

8. The container of claim 1, wherein the body comprises a permeation barrier material.

9. The container of claim 1, wherein the side wall is biodegradable.

10. The container of claim 1, wherein the container comprises a fibrous material.

11. The container of claim 1, wherein the heterocompositional frame portion is further configured to provide a contoured portion about the open end.

12. The container of claim 1, wherein the heterocompositional frame portion is further configured to provide a threaded portion about the open end.

13. A method of reinforcing a neck of a pulp-molded bottle, comprising:

providing a frame material that is heterocompositional to a material of the bottle;

applying the frame material to the neck of the bottle; and wherein the frame material is disposed between a pulp-molded portion and a permeation barrier.

14. The method of claim 13, wherein the frame material is paper.

15. The method of claim 13, wherein the frame material is string.

16. The method of claim 13, wherein the frame material is fibrous material.

17. The method of claim 13, wherein the frame material is a plant starch based polymer.

18. A container for housing a fluid, comprising:

a body having a first pulp-molded portion and a side wall that at least partially defines a coated lumen; and a neck coupled to the body, the neck having a second pulp-molded portion, a permeation barrier and a heterocompositional frame portion configured to rein force the neck; and wherein the frame portion is disposed within the second pulp-molded portion, and is biodegradable.

* * * * *